United States Patent [19]

Jundt et al.

[11] 4,202,304

[45] May 13, 1980

[54] INTERFERENCE PROTECTED ELECTRONIC IGNITION SYSTEM FOR AN INTERNAL COMBUSTION ENGINE

[75] Inventors: Werner Jundt, Ludwigsburg; Bernd Bodig, Leinfelden, both of Fed. Rep. of Germany

[73] Assignee: Robert Bosch GmbH, Stuttgart, Fed. Rep. of Germany

[21] Appl. No.: 919,617

[22] Filed: Jun. 27, 1978

[30] Foreign Application Priority Data

Jun. 30, 1977 [DE] Fed. Rep. of Germany ..... 2729505

[51] Int. Cl.[2] ..... F02P 9/00

[52] U.S. Cl. ..... 123/148 E; 315/209 T

[58] Field of Search ..... 123/148 E, 148 CD, 148 CA, 123/148 D; 315/209 T

[56] References Cited

U.S. PATENT DOCUMENTS

| | | | |
|---|---|---|---|
| 3,686,607 | 8/1972 | Berry | 123/148 D |
| 3,882,840 | 5/1975 | Adamian et al. | 123/148 E |
| 4,007,724 | 2/1977 | Mura | 123/148 E |
| 4,117,819 | 10/1978 | Jarrett et al. | 123/148 E |

*Primary Examiner*—Charles J. Myhre
*Assistant Examiner*—R. A. Nelli
*Attorney, Agent, or Firm*—Frishauf, Holtz, Goodman & Woodward

[57] ABSTRACT

To eliminate the effects of disturbances, noise and interference in the signal derived from a speed-dependent signal generator coupled to the engine on the threshold response level of a threshold switch which, upon sensing a leading flank of the signal, causes a controlled transistor switch to turn ON to pass current through an ignition coil and, upon sensing the trailing flank of the signal, turns the switch OFF to induce an ignition pulse, a supervisory circuit is connected to the threshold switch which provides a bias voltage thereto so that the threshold switch will accurately and reliably respond to the trailing flank of the signal from the signal generator even in the presence of noise and interference voltages at a predetermined angular position of the crankshaft of the engine—absent a shift in the relative angular position of the signal from the signal generator and the crankshaft of the engine—to prevent failure of generation of an ignition pulse, or untimely, uncontrolled generation thereof. The supervisory circuit may include a control charge capacitor providing a bias voltage or, for example, a Schmitt trigger set to respond at different threshold levels of the threshold switch and, upon such response, to provide a bias voltage thereto, thus causing the threshold switch to respond upon response of the Schmitt trigger even in the presence of signal disturbances.

9 Claims, 3 Drawing Figures

Figure 1:
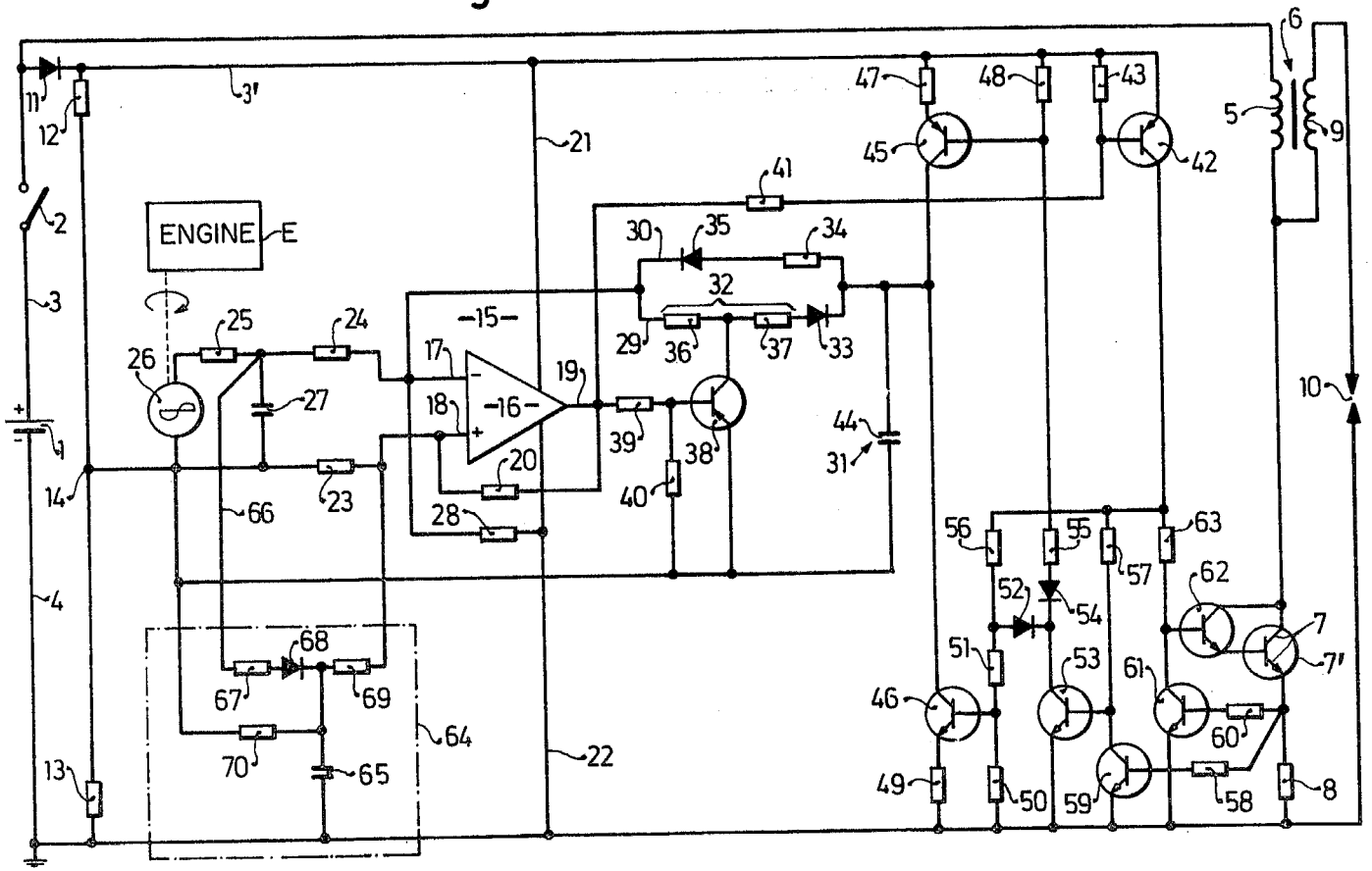

INTERFERENCE PROTECTED ELECTRONIC IGNITION SYSTEM FOR AN INTERNAL COMBUSTION ENGINE

The present invention relates to an electronic ignition system for an internal combustion engine, and more particularly to an interference or noise signal protected ignition system having a special circuit to positively associate the ignition instant with a predetermined crankshaft position even if the signal generator generating the ignition signal is subject to noise.

BACKGROUND AND PRIOR ART

It has previously been proposed to provide an ignition control system in which a signal generator generates an undulating signal which is applied to a threshold switch. When the threshold switch senses a first flank of the signal, for example a rising flank, it provides a closing signal to an electronic switch to close the circuit through an ignition coil. Current will thus flow through the ignition coil storing electromagnetic energy therein. When the threshold switch senses a threshold level, which may be different than the first, from the other flank of the signal, that is, from the trailing flank, an ignition trigger is generated to open the switch through the ignition coil, thus inducing a sharp voltage pulse, causing an ignition event in the secondary of the ignition coil.

Various devices and circuits may be used to change the relative occurrence of the ignition instant with respect to the crankshaft position of the engine. In the system described, this involves a change in the signal or the threshold level of the threshold switch, for example to advance the spark with respect to top dead center (TDC) position of a piston of the internal combustion engine. In the referenced publication, German Disclosure Document DE-OS 25 49 586, there is described such an ignition system in which an arrangement is provided to turn off the threshold switch, thus causing an ignition event to occur in the lower range of the speed range of the internal combustion engine. Thus, an ignition event will be triggered at approximately the same angular position—with respect to TDC of the piston—unless some circuits or devices cause an advance of the triggering of the ignition event. Regardless of the presence of such advancing signals or devices, however, an ignition event should always be triggered at the latest at this predetermined time with respect to TDC position of the piston. This predetermined time may, for example, by just in advance of or at the TDC position.

THE INVENTION

It is an object to improve the ignition system of the type above described by eliminating the limitation to lower speed ranges of always triggering an ignition event in the absence of a spark advancing or otherwise spark timing signal so that, regardless of the operation of the system, an ignition event will always be triggered at a predetermined angular position with respect to TDC position of a piston. It has been found that, specifically at higher speeds of the engine, eddy current losses and armature reactions of electromagnetic transducer signals may cause interference and noise influences on the signal triggering the ignition event. In accordance with the invention, however, the effect of such interference or noise signals is, essentially, eliminated.

Briefly, a supervisory circuit is provided to positively associate a predetermined threshold value of at least one flank of a triggering signal with the response of the threshold switch. The threshold switch itself is controlled by and connected to the signal generator which provides an undulated signal. The supervisory circuit provides a supervisory bias voltage to the threshold switch to bias the threshold switch to accurately respond, at the ignition instant, to the flank, typically the trailing flank of the signal from the signal generator even if noise and interference voltages are delivered by the signal generator.

The supervisory or monitoring circuit in its simplest form may include a supervisory capacitor and a charge circuit therefor, which is so connected that the charge voltage on the supervisory capacitor will, upon rising speed of the engine, provide a bias voltage to the threshold switch which positively maintains the response level thereof, in the absence of spark advancing, or otherwise spark time modifying signals. The charge circuit for the capacitor may also be so arranged that, upon rising speed, the bias tends to shift the threshold response level of the threshold switch in a direction to spark advance. Other monitoring circuits may be devised; for example, in another form, the leading flank of the ignition signal triggers a bistable circuiit, for example a Schmitt trigger, the trailing flank of which resets the Schmitt trigger to provide, thereupon, a bias voltage to the threshold switch causing the ignition event. The response levels of the Schmitt trigger preferably are different from those of the threshold switch controlling ignition current flow and providing a monitoring or supervisory function supporting the threshold switch, or to be effective in the absence of normal operation of the threshold switch.

Figure 2:
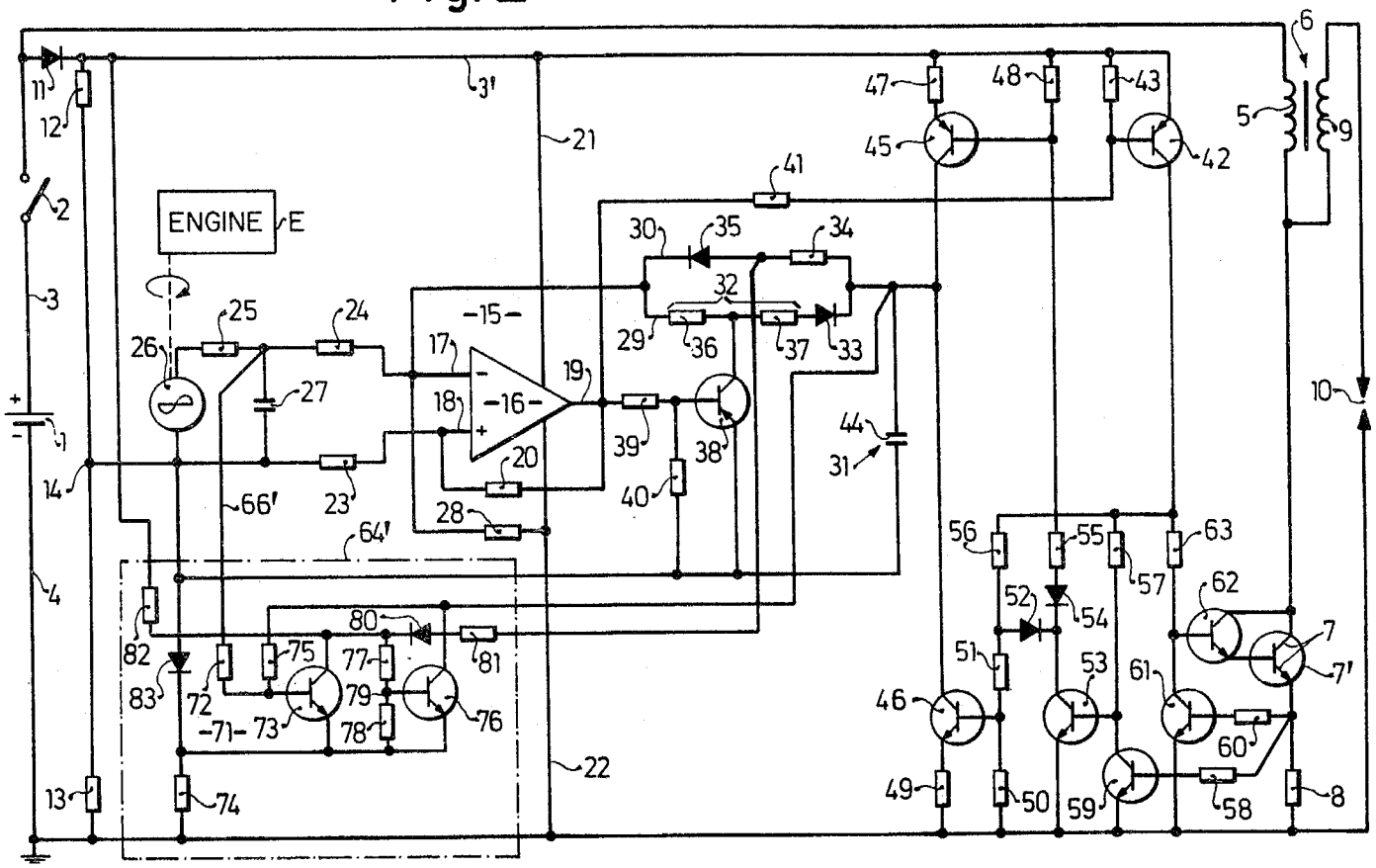
Figure 3:
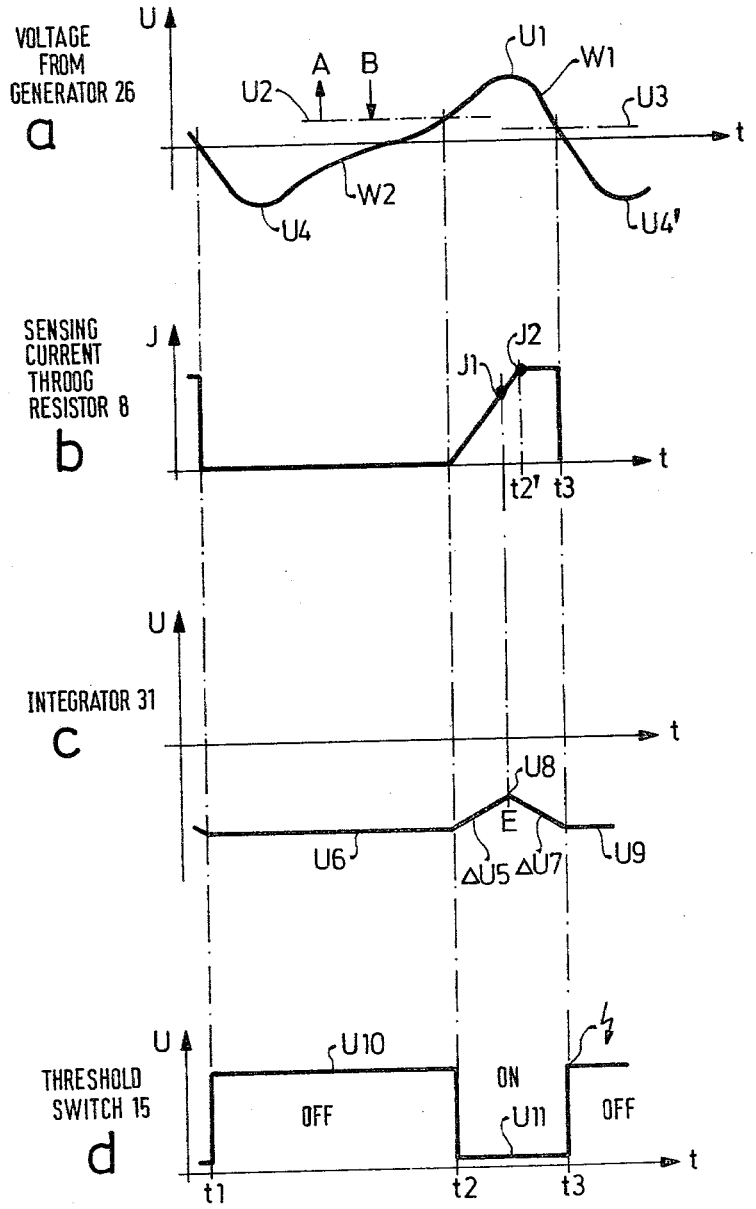

Drawings, illustrating preferred examples, wherein:

FIG. 1 is a schematic circuit diagram of the ignition system using a monitor circuit employing a charge capacitor;

FIG. 2 is a diagram similar to FIG. 1 and using a Schmitt trigger in the monitoring circuit; and FIG. 3 is a series of graphs illustrating the operation in accordance with the invention, with respect to time, wherein graph a shows the signal derived from a typical electromagnetic signal generator; graph b the current through a sensing resistor used in the circuit; graph c the voltage across an integrator capacitor used in the circuit; and graph d the voltage triggering the operation of the threshold switch.

An internal combustion engine E, for example of the multi-cylinder type and, for example, destined for automotive application, provides power to a battery 1, which provides the power for the ignition system. Battery 1, typically, is the storage battery of an automotive vehicle. The positive terminal of the battery 1 is connected to bus 3 and through a main switch 2 to the primary 5 of an ignition coil 6. The negative terminal of battery 1 is connected to ground, chassis, or a reference potential. The secondary 9 of the ignition coil 6 is connected, typically, through a distributor (not shown) to a plurality of spark gaps, typically spark plugs, of which only one, spark gap 10, is shown. The primary of the ignition coil 5 is connected through an interrupter switch 7 and a sensing resistor 8 to chassis bus 4. The interrupter switch 7, as shown, is the emitter-collector path of a transistor 7', typically in a Darlington circuit including the further transistor 62.

The control circuit for the transistor 7' is protected by a reverse polarity protective diode 11, the cathode of which is connected to a main supply bus 3'. A voltage divider built up of resistors 12, 13, connected across buses 3', 4, has a junction 14. The resistance of resistors 12, 13 are essentially equal, so that junction 14 will be at approximately of supply voltage, in an automotive vehicle, typically, 6 V.

A threshold switch 15, preferably in form of an operational amplifier 16, has an inverting input 17 and a direct input 18,and a positive feedback resistor 20. Operational amplifier 16 is supplied with power through lines 21, 22, respectively coupled to buses 3' and 4. The direct input 18 of operational amplifier 16 is connected through a resistor 23 to the junction 14. The inverting input 17 is connected through the series circuit of two resistors 24, 25 to one terminal of an electromagnetic signal transducer 26, coupled to the engine E and rotating therewith. The other terminal of the signal generator 26 is connected to the junction 14. The common junction of the two resistors 24, 25 is connected across terminal 14 through a capacitor 27, intended to filter out interfering or noise voltage pulses.

The inverting input 17 is connected, further, through a resistor 28 with the reference or chassis bus 4. It is further connected through two parallel connected control circuits 29, 30 with an integrator 31, the integration value of which provides the turn-ON threshold U2 (FIG. 3 graph a) which forms a control voltage for the threshold switch 15. The control branch 29 is built up of the series circuit of a resistor 32 and a diode 33, having its cathode connected to the integrator 31. The second control branch 30 is built up of the series circuit of a resistor 34 and a diode 35, the anode of which is connected to the integrator 31. The resistor 32 comprises two resistor elements 36, 37, the common junction of which is connected to the collector of a pnp transistor 38. The emitter of transistor 38 is connected to the junction 14. The base of transistor 38 is connected through a resistor 39 to the control output 19 of the operational amplifier 16; a resistor 40 connects the base to the junction 14. The control output 19 of the operational amplifier 16 is further connected over a coupling resistor 41 with the base of a pnp transistor 42 and through a resistor 43 to the bus 3', that is, to the cathode of diode 11.

The integrator 31, in its simplest form, is formed by a capacitor 44 which is connected between the parallel control circuits 29, 30 and the junction 14. Capacitor 44 may, however, be replaced by amplifying elements, for example by an operational amplifier connected as an integrator, or by other circuits.

The junction of integrator 31 and control branches 29, 30 is connected to the collector of a pnp transistor 45 and to the collector of an npn transistor 46. Transistor 45 has an emitter resistor 47 connecting the emitter thereof to bus 3'. The base of transistor 45 is connected through a resistor 48 to bus 3'. Transistor 45, thus, will operate as a constant current supply circuit. Transistor 46 is similarly connected to the bus 4, having an emitter resistor 49 and its base connected through a resistor 50 to bus 4. Transistor 46, likewise, will operate as a constant current circuit. The base of transistor 46 is additionally connected through a resistor 51 to the anode of a blocking diode 52, the cathode of which is connected to the collector of an npn transistor 53 as well as to the cathode of a second blocking diode 54, the anode of which is connected through a resistor 55 to the base of transistor 45. The anode of blocking diode 52 is connected through a resistor 56 to the collector of the transistor 42 and to one terminal of a resistor 57, the other terminal of which is connected to the base of an npn transistor 53.

The junction between transistor 7' and current measuring or sensing resistor 8 is connected to a branch circuit which includes a resistor 58 which connects to the base of an npn transistor 59, the emitter of which is connected to bus 4, and the collector to the base of transistor 53 and to the resistor 57. A further branch circuit from the junction between sensing resistor 8 and transistor 7' leads through a resistor 60 to the base of an npn transistor 61, the emitter of which is connected to bus 4 and the collector of which is connected through a resistor 63 to the collector of transistor 42 and to the base of the driver transistor 62 of the Darlington pair 62, 7'.

Current and voltage relationships, with reference to FIG. 3: The output voltage derived from an electromagnetic tachometer transducer, of the type customary in automotive applications, is illustrated in graph a of FIG. 3. The output voltage varies between negative and positive peak values U4 and U1. The leading flank between the negative peak value U4 and the positive peak value U1 forms a control signal which controls the turn-ON condition of the threshold switch; the trailing flank between the positive peak value U1 and the next subsequent negative peak value U4' forms the control signal for the turn-OFF command to switch 7, determining the ignition instant, that is, when a spark is to be generated across spark plug or spark gap 10. The leading flank, thus, is provided to trigger the threshold switch 15 ON, and the trailing flank to trigger the threshold switch 15 OFF. Operation of the threshold switch 15 is controlled by the resistor 28 such that, as the engine starts, threshold switch 15 will be turned ON by the positive half-wave portion W1 and will also be turned OFF during occurrence of the positive half-wave portion W1. Thus, and as seen in the graph a of FIG. 3, the ON threshold level U2 of switch 15 and the OFF threshold level U3 of threshold switch 15 will be slightly above the zero or null level of the a-c signal supplied by the signal generator 26.

The ON level U2 is so set that, as the engine increases in speed, it is shifted in the direction of arrow A towards the peak value U1 of the positive half wave W1. As the speed increases further, it recedes again from the positive peak U1 of the positive half wave W1 of the wave derived from the signal generator and wanders in the direction of the arrow B, crossing the zero or null level to almost the negative peak value U4 of the negative half-wave portion W2 of the a-c signal supplied by the signal generator. Shifting the ON threshold U2, that is, shifting of the ON threshold of switch 15, is obtained by changing the integration value U6 —see graph c of FIG. 3—by varying the portion ΔU5. The integration value U6 thus is changed in a first change ΔU5 applied to the threshold switch upon increase of speed of the engine.

The termination of the first change ΔU5 and the begin of a subsequent second change ΔU7 of the integration value U8 —see FIG. 3, graph c—is made dependent on the rise of current flow through the primary 5 of ignition coil 6 in dependence on a current value J1. Current flow through the coil is illustrated in graph b of FIG. 3. The termination of the second change ΔU7 is given by the turn-OFF of the threshold switch 15. The then present integration value U9 on the integrator will remain, at least approximately, until the next cycle. This integration value will be approximately constant until again a new first change occurs. The first change ΔU5 and the second change ΔU7 is preferably so set that the respective changes will be symmetrical with respect to a vertical E passing through the value U8 unless the speed of the engine changes. Change-over of the first change ΔU5 to the second change ΔU7 can be determined by suitable choice of the current flowing through the sensing or measuring resistor 8, that is, the current level J1. The current may continue to flow and rise to a second level J2 at which time sufficient electromagnetic energy is stored in the ignition coil 6 to provide sufficient ignition energy for the engine.

The changes ΔU5, ΔU7, as shown, are caused by the same current levels, the change ΔU5 corresponding to a rise in voltage and the change ΔU7 corresponding to a drop in voltage.

The control output 19 of the threshold switch 15 provides two output levels which correspond, essentially, to the voltage at bus 3' and to the voltage of the bus 4, respectively. As seen in graph d of FIG. 3, the voltage U10 in the OFF state of threshold switch 19, that is, in the time between t1 and t2, is approximately that of bus 3'. The voltage U11, in the ON time of the threshold switch 15, that is, between time t2 and t3, corresponds, approximately, to that of bus 4.

Turn-OFF of the threshold switch 15, that is, the timing of time t3, causing an ignition even should occur slways at the same angular position of the crankshaft of the engine unless ignition timing is changed by external control signals. Such external control signals may, for example, be derived from vacuum change devices responding to vacuum in the induction pipe of the internal combustion engine, centrifugal spark advance devices, and the like. They may, for example, be coupled mechanically to the signal transducer 26.

To positively associate the ignition event or instant with the crankshaft position represented by the signal derived from signal source 26, a monitoring circuit 64 is provided, in accordance with the invention, which provides a bias to the threshold switch 15 so that the bias on switch 15 is so changed that the turn-OFF of switch 15 will always occur in the same angular position of the crankshaft (unless the signal derived from source 26 has changed this angle). As shown, the monitoring circuit 64 comprises a monitoring capacitor 65 which is connected to a branch circuit 66 connected to the signal source 26. The branch circuit 66 is coupled to the junction between the filter network formed by resistors 24, 25 and capacitor 27 and includes the resistor 25; branch circuit 66 then further includes a resistor 67 connected to the anode of a blocking diode 68, and is then connected from the cathode thereof to the capacitor 65, the other terminal of which is connected to chassis or reference bus 4. The cathode of diode 68, and hence the capacitor 65, is connected through resistor 69 with the direct input 18 of the threshold switch 15. A resistor 70 likewise connects this terminal to terminal 14 of the voltage divider 12, 13.

Operation of ignition system, and monitoring circuit: Upon closing of main operating switch, and starting of the internal combustion engine E, a control signal will be derived from signal generator 26. As the shaft of the engine E begins to rotate, a signal from the signal generator 26 will be obtained; when this signal reaches the turn-ON threshold U2 of threshold switch 15, the voltage at the output 19 thereof will change from voltage U10 to voltage U11 (FIG. 3—graph d) which, as noted, corresponds approximately to chassis or reference voltage. Control current will then flow over the base-emitter path of transistor 42, causing the emitter-collector path to be conductive, triggering the Darlington pair 62-7' and permitting current to flow through the ignition coil 5, to store electromagnetic energy therein.

Upon conduction of the emitter-collector path of transistor 42, the base-emitter path of transistor 53 will receive current so that the emitter-collector path will receive control current and transistor 45 will become conductive. Integrator 31 will now receive the first change ΔU5 of its previous integration value U6, which terminates as soon as current flow in the primary 5 has reached the monitoring supervision value J1. The voltage drop at the sensing resistor 8 then will have a value at which the emitter-collector path of transistor 59 becomes conductive, thus short-circuiting the base-emitter path of transistor 53 which will, in turn, control transistor 45 to block. The emitter-collector path of transistor 42 will supply control current, however, to the transistor 46 and the now conductive emitter-collector path of transistor 46 will effect the second change ΔU7, starting with the peak integration value U8. Upon continued rotation of the shaft of the engine, the signal from generator 26 will reach the level U3. The second change ΔU7 is terminated as soon as the control signal derived from the signal generator 26 has reached the OFF threshold level U3 of the threshold switch 15. The voltage at the control output 19 of the threshold switch 15 then will change to the voltage U10 which, as above noted, corresponds to approximately that of supply bus 3'. No more control current will flow to the base-emitter path of transistor 42, which will block. This blocks control current on the base-emitter path of transistor 46, causing its emitter-collector path to block, and the second change ΔU7 on the integrator 31 will terminate. Upon transition of the emitter-collector path of transistor 42 into blocking state, the Darlington pair 62-7' will block, causing sudden interruption of the current through the primary 5 of the ignition coil and a high voltage pulse at the secondary 9, causing an ignition spark at the spark plug 10.

Transistor 61 provides for maintenance of current flow in the primary 5 when the current has reached the required value J2, necessary to store sufficient electromagnetic energy therein. After the current has reached this command value J2, the emitter-collector path of transistor 61 will become slightly conductive due to the voltage drop across the sensing resistor 8. Current flow through the emitter-collector path of the transistor 7' is thus limited in dependence thereon. It is recommended to so set the current J2 that the current through the primary 5, upon starting of the engine, will continue to flow after it has reached the command value J2 at that level J2 for a certain period of time, indicated in graph b of FIG. 3 at t2' to t3 so that, upon acceleration of the vehicle driven by the engine, substantial and still sufficient ignition energy will be stored in the ignition coil although the duration of current flow through the primary 5 will decrease.

The second change ΔU7 will extend over a longer period of time in low speed ranges of the engine than the first change ΔU5, so that the integration value U9 after the second change ΔU7 will be more negative than the integration value U6 before the first change ΔU5. This effect reacts on the first branch circuit 29 connected to the inverting input 17 of the operational amplifier 16 in such a manner that the turn-ON threshold level U2 of the threshold switch 15 shifts in the positive direction A (FIG. 3, graph a). Upon further increase of speed of the engine, the second change ΔU7 at the integrator will extend over a shorter period of time than the first change ΔU5, so that the integration value U9 after the second change ΔU7 will be more positive than the integration value U6 before the first change ΔU5. This effect will result in change of the turn-ON level of the threshold switch 15 in the negative direction indicated by arrow B in graph a, FIG. 3, due to the presence of the two control branches 29, 30. As the integration value U9, with respect to the junction 14, will become more positive, the second control branch 30, which is a lesser resistance branch than the control branch 29, will so react on the inverting input 17 that the turn-ON threshold level U2 of switch 15 becomes more negative. Thus, engine speed affects threshold levels.

Control current will be supplied to the base-emitter path of transistor 38 when the threshold switch 15 is ON, so that the emitter-collector path of the transistor 38 is conductive. The common junction of the resistors 36, 37 will thus change to about the voltage of the junction 14 so that the influence on the threshold switch 15 by the integrator 31 is inhibited. Thus, the switching threshold level U3 controlling switch 15 to turn OFF will be stabilized as long as the switching threshold level U2 is in the range between its initial position and the peak value U1 of the positive half wave W1. The threshold level U2 of the threshold switch 15 thus may reliably move within its shifting range, ensuring that the ignition instant will always occur at the same angular crankshaft position, as determined by threshold level U3 unless the entire signal derived from the signal generator 26 is shifted with respect to TDC position of a piston, as aforementioned, or unless other signal parameters are introduced to effect such as shift.

Let it be assumed that the speed of the engine still increases further. The threshold level U2 thus will change beyond its position in negative direction B (FIG. 3—graph a). The charge voltage of the monitoring capacitor 65 connected to the inverting input 18 of the threshold switch 15 is now used to maintain the threshold level U3 in its position or, even, to shift it in a direction opposite that of the shift of the threshold level U2, that is, in the direction of the arrow A, that is, towards the peak value U1. The monitoring capacitor 65 is charged by the control signal which also controls operation of the threshold switch 15, and hence, the turn-ON and turn-OFF response of the circuit during the essentially half wave W1 provided by the signal generator 26 (FIG. 3, graph a). As the speed of the engine increases, the peak value U1 of the half wave W1 will increase, thus increasing the charge voltage on the monitoring capacitor 65. The effect of the voltage available at the integrator 31, upon increasing speed of the engine on the threshold switch 15 is thus compensated. Upon suitable dimensioning of the circuit elements it is possible provide a voltage from the monitoring capacitor 65 which has a greater influence on the operational amplifier 16 than the voltage from integrator 31, so that the change-over threshold U3 will not only maintain its position but, even, shift in the direction of the peak value U1. It is thus possible to suppress those interferences with ignition timing which are caused by speed-dependent change of the slope of the trailing flank of the control signal derived from signal generator 26.

The monitoring capacitor 65 does not affect the threshold level U2 of the threshold switch 15 since the capacitor, upon response of the threshold switch 15 at time t2, is effectively discharged over resistors 69, 23 and 13, 70.

The monitoring circuit may be used with ignition systems which are similarly constructed but in which the threshold switch 15, controlling the electronic switch 7, does not have a shifting initial threshold level corresponding to the changeover at time t2.

Embodiment of FIG. 2: The basic system is similar to that FIG. 1, and similar elements, operating similarly, have been given the same reference numerals and will not be described again.

Basically, the difference between the embodiment of FIGS. 1 and 2 is the construction of the monitoring circuit. Circuit 64' includes a threshold switch 71 in the form of a Schmitt trigger, which operates to render ineffective the voltage derived from integrator 31 acting on the threshold switch 15 when the threshold switch 15 turns OFF. The branch circuit 66' connected to the junction between resistors 24, 25 includes a resistor 72, the base-emitter path of an input transistor 73 forming part of the threshold switch 71, a resistor 74 and the resistor 13 which forms part of the voltage divider, connected to junction 14 where the circuit is closed. The base of the input transistor 73 is connected over a resistor 75 to the collector of output transistor 76 of the threshold switch 71, the collector being connected to the junction between the branches 29, 30 and integrator 31. Two resistors 77, 78 form a voltage divider connected across the emitter-collector path of transistor 73, the junction point 79 of which is connected to the base of transistor 76. The emitter of transistor 76 is likewise connected to the emitter of transistor 73 and to the other terminal of resistor 78. The resistor 77 has its other terminal connected to the collector of transistor 73 and to the cathode of a blocking diode 80, the anode of which is connected through a resistor 81 to the junction between the anode of diode 35 and resistor 34 of branch circuit 30. Diode 80 is a blocking diode. A resistor 82 is connected to the collector of input transistor 73 and to bus 3' to supply current thereto.

The second threshold switch 71 is triggered by the leading flank of the control signal to change state which has as its effect to disconnect the influence of the bias voltage derived from the integrator 31 and applied to the threshold switch 15. The trailing flank of the control signal effects a second change of state of the trigger 71 to add a bias voltage from integrator 31 on the threshold switch 15.

The first change-over of threshold switch 15 is selected to occur at a voltage value at which the threshold switch 15 would remain in its ON state without any effect of the bias voltage from the integrator 13. The second change-state of threshold switch 71 is selected to occur at a voltage value at which the threshold switch 15 would remain in its OFF state without influence of the auxiliary voltage from integrator 31.

Operation—Circuit of FIG. 2, and in contrast to operation of the circuit of FIG. 1: When the leading flank of the control signal reaches the threshold level of the switch 71, the emitter-collector path of input transistor 73 will become conductive; the emitter-collector path of the output transistor 76 will thus block. At this point in the cycle, threshold switch 15 is already ON (between time t2 and t3), and threshold switch 15 remains in this state until it is turned OFF by the trailing flank of the control signal. Since the emitter-collector path of the input transistor 73 is conductive, a definite predetermined voltage will be applied between the resistor 34 and diode 35 of branch 30. In the present case, this voltage has the value which is present on the terminal of resistor 74 which is not connected to bus 4. Thus, the bias on the threshold switch 15 cannot be influenced by the voltage on integrator 31 so that the output threshold level U3 of the threshold switch 15 will retain its predetermined level.

When the control signal from signal generator 26 reaches the turn-OFF threshold level of the second threshold switch 71, the emitter-collector path of input transistor 73 is controlled to be blocked, causing the emitter-collector path of output transistor 76 to become conductive. The auxiliary voltage from integrator 31 can now be supplied over branch 30 to the inverting input 17 of the threshold switch 15 and thus the operating conditions corresponding to the turn-ON level U2 of the threshold switch 15 will be determined. The turn-OFF threshold of the second threshold switch 71 occurs when the influence of the bias voltage from integrator 31 to the base of the input transistor 73 is compensated by the voltage derived from the signal generator 26, so that the emitter-collector path of the input transistor 73 will block.

In all other respects, the circuit of FIG. 2 operates similarly to that of FIG. 1, and the remainder of the cycle of the ignition system is similar.

Various changes and modifications may be made, and features described in connection with any one of the embodiments may be used with the other, within the scope of the inventive concept.

We claim:

1. Ignition system for an internal combustion engine (E) having a signal generator (26) adapted to be coupled to the engine and providing an a-c signal in synchronism with the angular position of the shaft of the engine upon rotation of the engine, said signal having leading and trailing flanks;

an ignition coil (5, 6, 9);

a controlled switch (7) in series with the primary (5) of the ignition coil which, upon closing, permits current to flow through the coil to store electromagnetic energy therein and, upon opening, causes induction of a high voltage pulse in the secondary (9) to generate an ignition pulse;

a threshold switch (15) sensing when the leading and trailing flanks of the a-c signal pass respective threshold values (U2, U3);

connection means (41, 42) connected to the threshold switch and controlling closing and opening of the controlled switch (7);

and comprising, in accordance with the invention, means (64, 64') to positively associate a predetermined threshold value of the trailing flank with the response of the threshold switch (15) including a supervisory circuit connected to and providing a supervisory bias voltage to the threshold switch (15) to bias the threshold switch to respond to the trailing flank of the signal from the signal generator (26) at predetermined angular positions of the shaft of the engine even in the presence of noise and disturbance voltages of the signal derived from the signal generator; and a circuit branch (66) connecting the signal generator (26) and the supervisory circuit (64, 64') furnishing said bias voltage to thereby associate supply of the bias voltage with a predetermined angular position of the shaft of the engine and hence associate the instant of time that the trailing flank of the signal passes the respective threshold value (U3) with a predetermined angular position of the shaft of the engine.

2. System according to claim 1, further including a bias control circuit (31) providing a variable bias to the threshold switch (15) in dependence on an operating parameter of the engine to shift the threshold response level (U2) of the threshold switch (15) in dependence on change in said operating parameter.

3. System according to claim 2, wherein said bias control circuit provides a variable bias depending upon speed of the engine as reflected by the a-c signal derived from the signal generator (26).

4. System according to claim 2, wherein said bias control circuit comprises an integrator (31) connected to and controlled by the signal generator and providing an integrated signal representative of speed of the engine to bias the threshold switch (15).

5. System according to claim 1, wherein (FIG. 1) the supervisory circuit (64) includes a capacitor (65) and circuit means (64, 68) connected to said signal generator (26) to charge the capacitor, the charge voltage across the capacitor (65) being applied to the threshold switch to maintain the turn-OFF threshold level (U3) of the threshold switch in a first range of speed of operation of the engine, and hence rotation of said signal generator (26) upon rising speed, at an essentially even level, or at a level shifting towards the peak value (U1) of the signal from the signal generator (26).

6. System according to claim 1, wherein the threshold switch (15) is connected to render ineffective the supervisory bias voltage supplied by the supervisory circuit (64, 64') upon change of state of the threshold switch (15) in a direction to turn OFF the controlled switch (7) in series with the primary (5) of the ignition coil (6).

7. System according to claim 1, wherein (FIG. 2) the supervisory circuit (64') comprises a second threshold switch (71); and a branch circuit (66') connecting the signal generator (26) to the second threshold switch (71) to control the response of the second threshold switch as a function of the signal derived from the signal generator (26).

8. System according to claim 7, wherein the second threshold switch (71) is responsive to the leading flank of the a-c signal derived from the signal generator (26) and changes state upon sensing a predetermined threshold level of said leading flank, the threshold switch assuming a first state;

means (80,81) connecting a signal representative of said first state to the threshold switch (15) to disable the influence of external signals on the threshold switch;

the threshold switch then responding to the trailing flank of the signal from the signal generator (26) to again change state to assume a second state, and circuit means (30, 31) applying a bias voltage to the first threshold switch (15) to positively control the threshold response level thereof;

the threshold response level of the second threshold switch (71) upon changing to said first state being at a threshold level at which the first threshold switch will remain in a state controlling conduction of said controlled switch (7) absent a bias voltage; and wherein the threshold level of the second threshold switch (71) to change the second threshold switch to the second state is at a level in which the first threshold switch controlling conduction of the controlled switch (7) controls said controlled switch to OFF state even absent the auxiliary bias voltage.

9. System according to claim 8, further including an integrating circuit (31, 44) connected to the output of the first threshold switch and to the signal generator (26), the charge on the integrator providing a speed-dependent bias signal to the first threshold switch (15).

* * * * *